US007171706B2

(12) United States Patent
Piretti

(10) Patent No.: US 7,171,706 B2
(45) Date of Patent: Feb. 6, 2007

(54) SOFA CONVERTIBLE INTO A BED

(75) Inventor: Giancarlo Piretti, Bologna (IT)

(73) Assignee: Pro-Cord Spa, Bologna (IT)

( * ) Notice: Subject to any disclaimer, the term of this patent is extended or adjusted under 35 U.S.C. 154(b) by 78 days.

(21) Appl. No.: 10/891,431

(22) Filed: Jul. 14, 2004

(65) Prior Publication Data

US 2005/0204469 A1 Sep. 22, 2005

(30) Foreign Application Priority Data

Jul. 14, 2003 (EP) ..... 03425463

(51) Int. Cl.
*A47C 17/04* (2006.01)

(52) U.S. Cl. ..... 5/18.1; 5/48

(58) Field of Classification Search ..... 5/47, 5/48, 18.1, 17, 19–21
See application file for complete search history.

(56) References Cited

U.S. PATENT DOCUMENTS

| | | | | | |
|---|---|---|---|---|---|
| 521,595 | A * | 6/1894 | Nye | 5/158 |
| 915,651 | A * | 3/1909 | Appel | 5/158 |
| 1,321,911 | A * | 11/1919 | Hawkins | 5/12.1 |
| 1,845,791 | A * | 2/1932 | Gray | 5/99.1 |
| 2,243,691 | A * | 5/1941 | Bakalar | 5/93.1 |
| 2,265,671 | A * | 12/1941 | Quadri | 312/204 |
| 2,568,366 | A * | 9/1951 | Rosen | 5/18.1 |
| 2,853,717 | A * | 9/1958 | Firsel | 5/17 |
| 3,019,454 | A * | 2/1962 | Luca | 5/17 |
| 3,064,276 | A * | 11/1962 | Newsom, III | 5/17 |
| 3,729,753 | A * | 5/1973 | Johnson et al. | 5/2.1 |
| 3,896,512 | A * | 7/1975 | Black | 5/17 |
| 3,974,529 | A * | 8/1976 | Johnson et al. | 5/18.1 |
| 4,204,287 | A * | 5/1980 | Lane et al. | 5/18.1 |
| 4,366,585 | A * | 1/1983 | Ponti et al. | 5/18.1 |
| 4,481,684 | A * | 11/1984 | Hauck | 5/18.1 |
| 4,586,206 | A | 5/1986 | Singer | 5/18 R |
| 4,633,539 | A * | 1/1987 | Morrison | 5/660 |
| 4,825,483 | A * | 5/1989 | Nassar | 5/12.1 |
| 4,953,242 | A * | 9/1990 | Harris | 5/18.1 |
| 5,101,524 | A * | 4/1992 | Brandschain | 5/17 |
| 5,519,904 | A * | 5/1996 | Wukicsevics et al. | 5/400 |
| 5,920,928 | A * | 7/1999 | Piretti | 5/18.1 |
| 2004/0128762 | A1 * | 7/2004 | Weinman | 5/411 |

FOREIGN PATENT DOCUMENTS

| | | |
|---|---|---|
| DE | 296 03 078 U1 | 4/1996 |
| EP | 0 811 341 A2 | 12/1997 |
| FR | 2 036 678 | 12/1970 |
| JP | 3-212211 | 9/1991 |

* cited by examiner

*Primary Examiner*—Robert Canfield
*Assistant Examiner*—Gay Ann Spahn
(74) *Attorney, Agent, or Firm*—Seed IP Law Group PLLC

(57) ABSTRACT

The disclosure generally describes a sofa convertible into a bed. In one embodiment, the sofa includes a support and guide structure, and a mattress that is movable relative to the support and guide structure. The sofa can be moved between a bed configuration and a sofa configuration. In the bed configuration, the mattress has a bearing surface which extends horizontally. In the sofa configuration, an upper portion of the mattress is folded upwards relative to a lower portion of the mattress. In addition, the bearing surface of the upper portion of the mattress forms the bearing surface of a backrest for supporting the back of a person in a seated position.

1 Claim, 7 Drawing Sheets

SOFA CONVERTIBLE INTO A BED

BACKGROUND OF THE INVENTION

1. Field of the Invention

The present invention generally relates to a sofa convertible into a bed.

2. Description of the Related Art

The document EP-A-811341 by the same Applicant discloses a sofa convertible into a bed in which the mattress in the sofa configuration is folded underneath the sliding support structure. In this known solution, the stationary support structure of the sofa-bed comprises a backrest structure borne by two support arms which are connected to the rear support legs of the sofa. The backrest structure is capable of assuming a vertical configuration in which it forms the head of the bed or a rearwards folded configuration forming the backrest of the sofa.

The documents U.S. Pat. No. 2,568,366 and U.S. Pat. No. 4,586,206 describe sofas convertible into beds with the characteristics contained in the preamble of the main claim. In both these known solutions, the mattress is movable relative to a support and structure guide between a bed configuration in which the mattress extends horizontally and a sofa configuration in which an upper portion of the mattress is folded upwards relative to a lower portion. The support structure of the sofa comprises a stationary backrest structure with a rear wall and a front wall, mutually distanced and defining a compartment which, in the sofa configuration, receives the upper portion of the mattress.

BRIEF SUMMARY OF THE INVENTION

One object of the present invention is to provide a sofa convertible into a bed having a simpler, more compact and more economical structure.

According to one aspect, a sofa that is convertible into a bed includes a support, guide structure and mattress. The mattress can be movable relative to the support and guide structure between a bed configuration and a sofa configuration. The bed configuration provides a bearing surface of the mattress that extends horizontally. The sofa configuration provides an upper portion of the mattress that is folded upwards relative to a lower portion of the mattress. The upper portion of the mattress forms a bearing surface for a backrest.

BRIEF DESCRIPTION OF THE SEVERAL VIEWS OF THE DRAWINGS

A preferred embodiment of the present invention shall now be described with reference to the accompanying drawings, provided purely by way of non limiting example, in which.

DETAILED DESCRIPTION OF THE INVENTION

Figure 1:
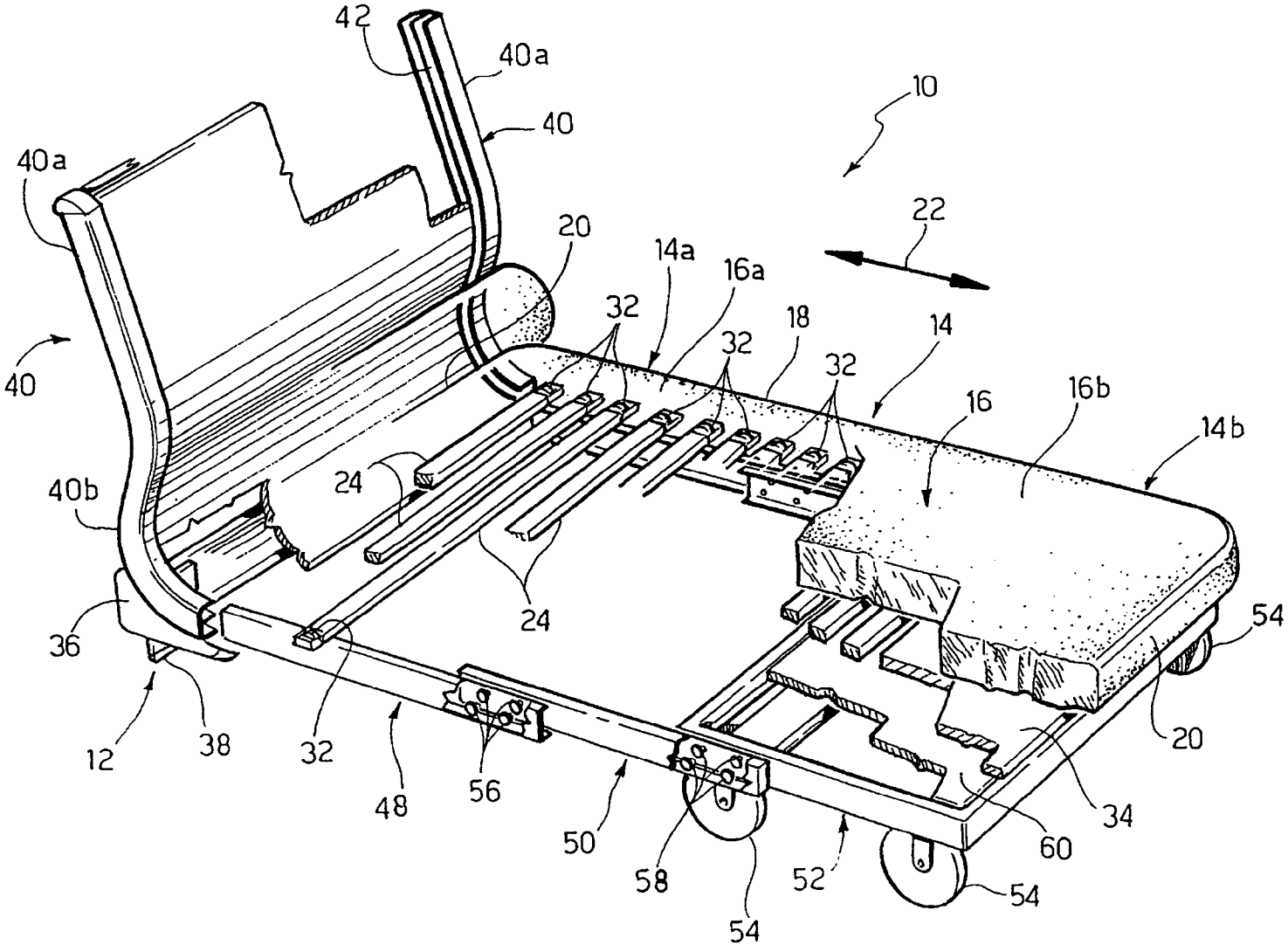
FIG. 1 is a partially sectioned view of a sofa-bed according to the present invention in bed configuration.
Figure 2:
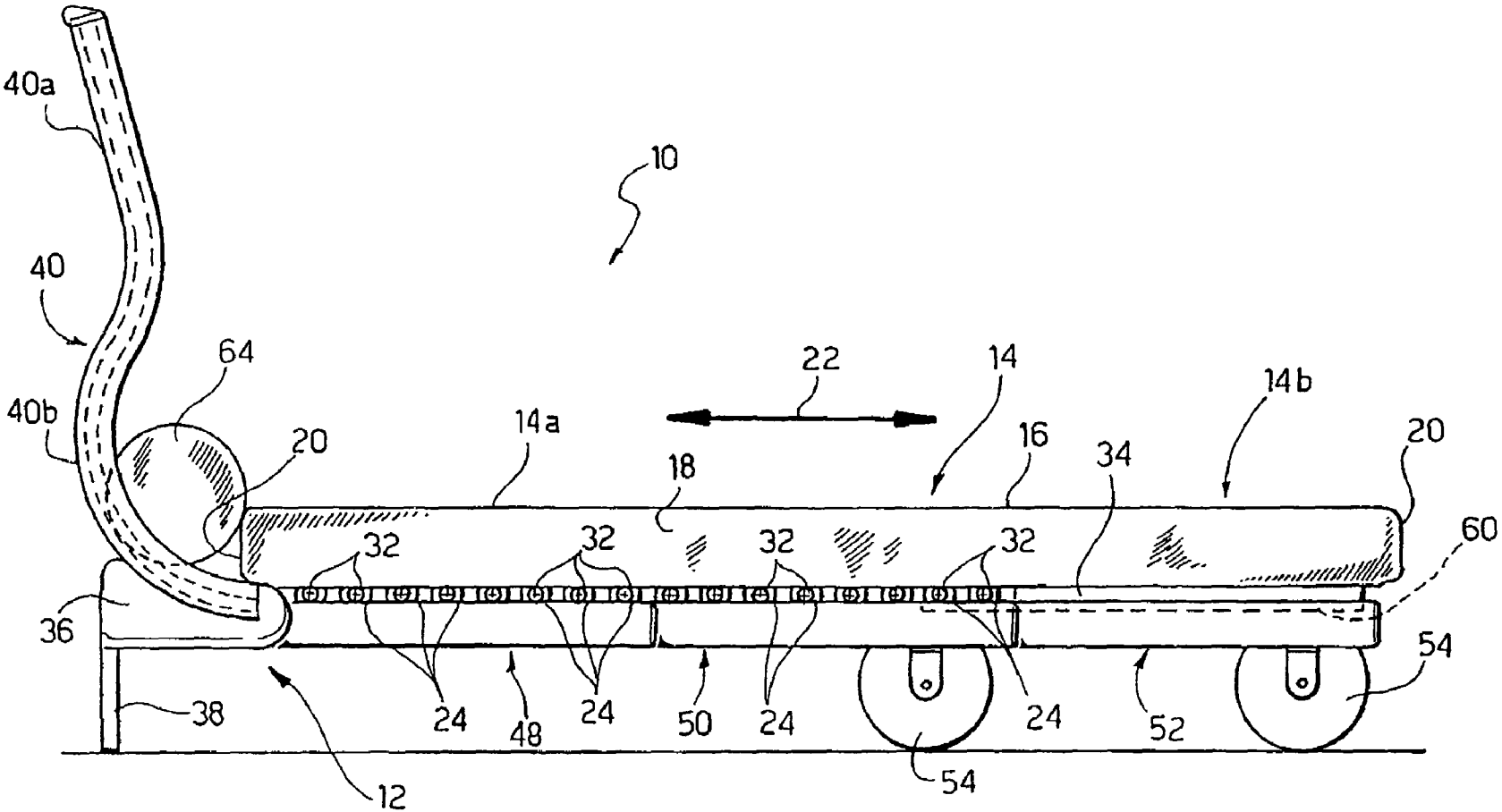
FIG. 2 is a side view of the sofa-bed of FIG. 1.
Figure 4:
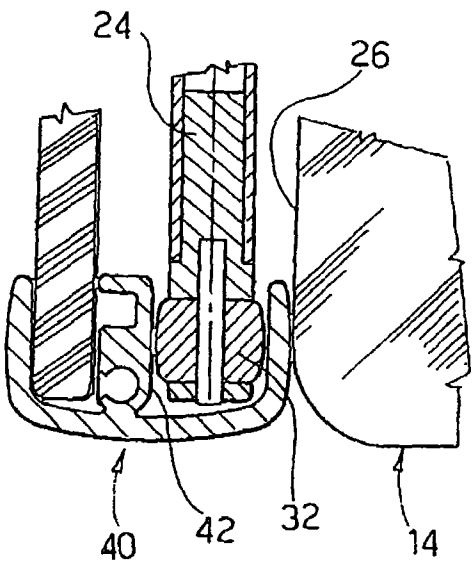
FIG. 4 is a partial section in enlarged scale according to the line IV—IV of FIG. 3.

With reference to FIGS. 1 and 2, the reference number 10 indicates a sofa convertible into a bed according to the present invention. The sofa-bed 10 comprises a support and guide structure 12, movable between an extracted position and a retracted position in the manner that will be described below. The support and guide structure 12 bears a mattress 14 having a bearing surface 16 which in the bed configuration illustrated in FIGS. 1 and 2 extends horizontally and whereon is destined to bear the occupant or the occupants of the bed in reclined position. In the bed configuration, the mattress 14 has a rectangular shape with two greater sides 18 and two smaller sides 20. The mattress 14 is movable between a sofa configuration and a bed configuration and vice versa in the direction designated by the double arrow 22 in FIGS. 1 and 2. According to a preferred characteristic of the present invention, the greater sides 18 of the mattress 14 extend parallel to the direction of motion 22 of the mattress 14.

Figure 3:
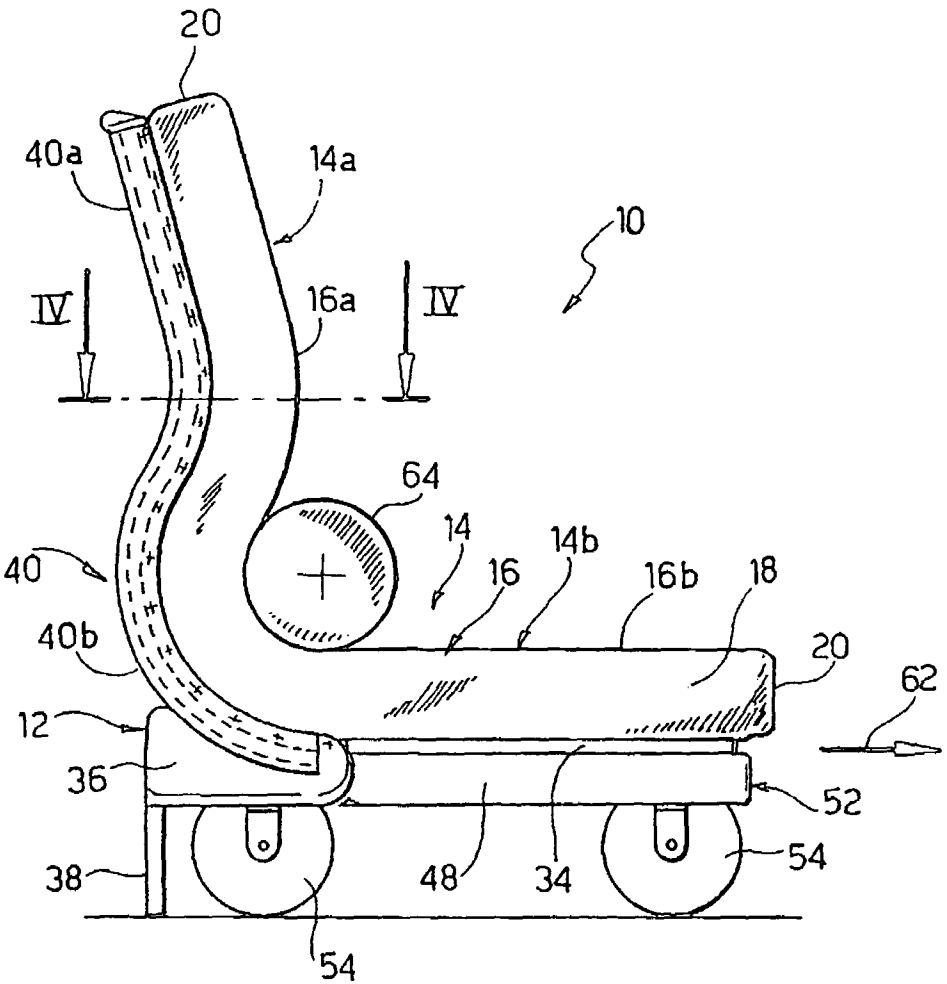
FIG. 3 is a side view showing the sofa-bed according to the invention in sofa configuration.

With reference to FIGS. 1, 2 and 3, the mattress 14 has an upper portion 14*a* and a lower portion 14*b*. In the bed configuration, the two portions 14*a*, 14*b* are substantially aligned and coplanar to each other. In the sofa configuration shown in FIG. 3, the upper portion 14*a* extends upwards relative to the lower portion 14*b*, according to a general "L" configuration. In the sofa configuration shown in FIG. 3, the bearing surface 16*a* of the upper mattress portion 14*a* constitutes the bearing surface of the backrest of the sofa, against which directly bears the back of an occupant of the sofa in the sitting position. The bearing surface 16*b* of the lower mattress portion 14*b* in the sofa configuration constitutes the seating surface.

Figure 6:
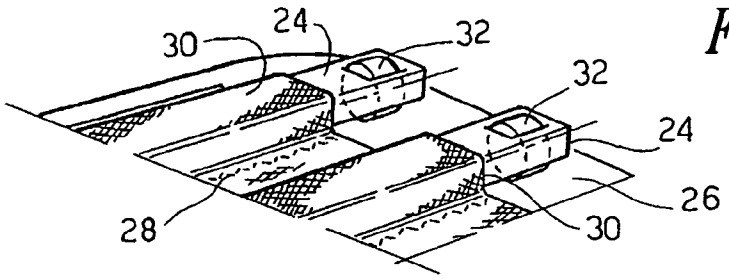
FIG. 6 is a partial perspective view of the part designated by the arrow VI in FIG. 5.
Figure 5:
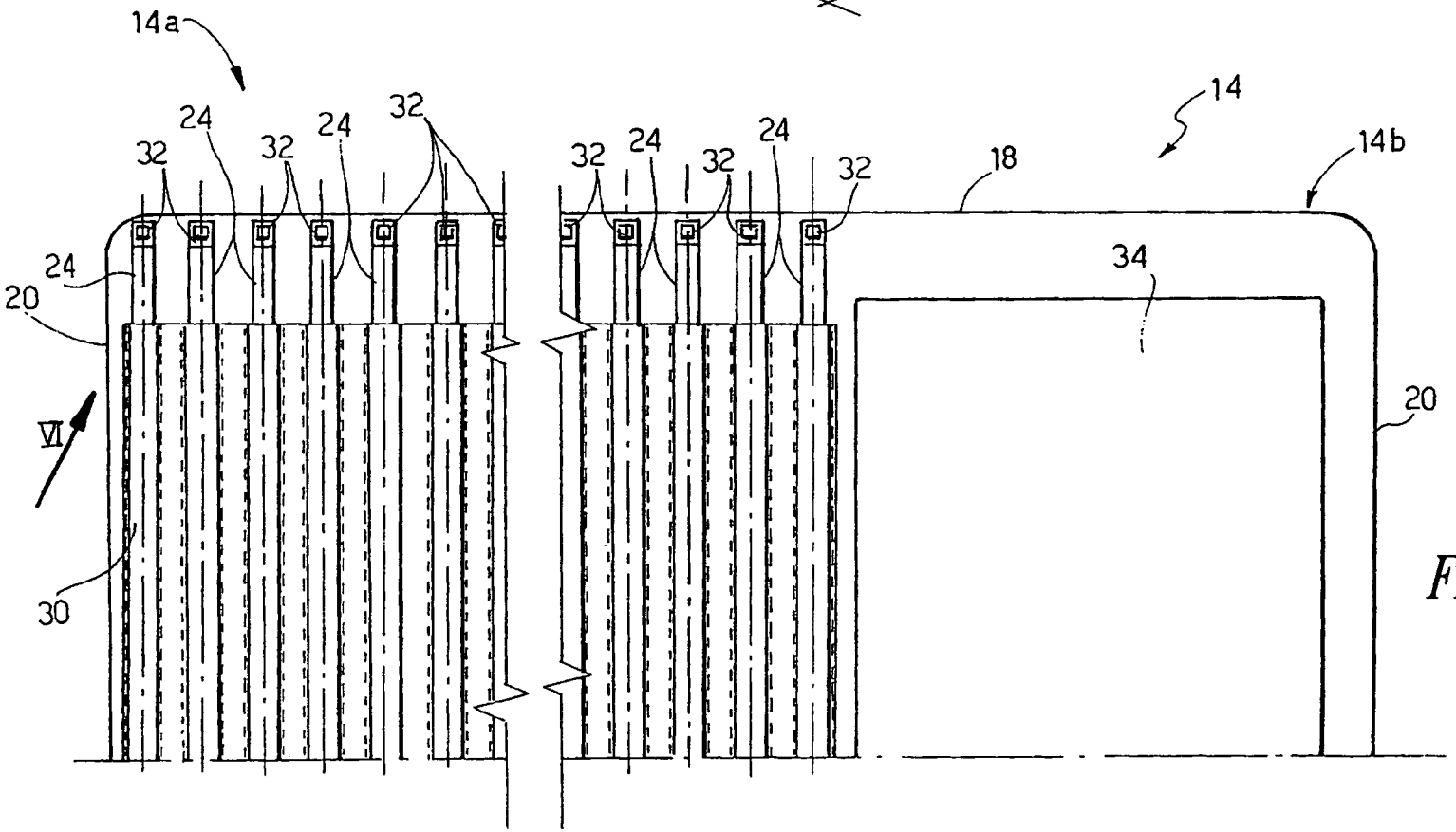
FIG. 5 is a partial plan bottom view of a mattress of a sofa-bed according to the invention.

With reference to FIGS. 1, 5, and 6, the upper portion 14*a* of the mattress 14 bears a plurality of support rods 24 which extend parallel to the smaller sides 20 of the mattress 14. The support rods 24 are applied to the lower surface 26 of the mattress 14, opposite to the bearing surface 16. Preferably, on the lower surface 26 of the mattress 14 is sewn a layer of fabric 28 forming a plurality of transverse tubular seats 30 (FIG. 6) within each of which is inserted a respective support rod 24. Each rod 24 is provided at each of its ends with an idle guide roller 32, free to rotate about a transverse axis.

Preferably, the support rods 24 extend only along the upper part 14*a* of the mattress 14, which occupies about ⅔ of the total length of the mattress 14. The lower portion 14*b* of the mattress 14 is preferably provided on its lower surface with a panel of yielding material 34, preferably made of elastomeric material. The panel 34 can be applied on the lower surface of the lower portion 14*b* by stitching or by means of Velcro® tape. Preferably, the panel of yielding material 34 has a thickness that is substantially equal to the thickness of the support rods 24.

With reference to FIGS. 1 through 3, the support and guide structure 12 of the sofa-bed 10 comprises a stationary base 36 provided with one or more ground support elements 38. Two guide uprights 40 are fastened to the support base 36 and extend upwards starting therefrom. The two guide uprights 40 extend on the two opposite sides of the sofa-bed 10. Each of the guide uprights 40 has a guide channel 42 engaged in sliding fashion by the rollers 32 borne by the support rods 24. The guide uprights 40 have an upper portion 40*b* with substantially rectilinear shape and a lower portion 40*a* with an arched shape, with the concavity oriented towards the front part of the sofa-bed 10.

The support and guide structure 12 comprises two stationary, mutually parallel horizontal guides 48, fastened to the support base 36 in the vicinity of the lower ends of the guide uprights 40. The two stationary horizontal guides 48 bear two movable horizontal guides 50, able to move telescopically relative to the stationary guides 48 in the direction indicated by the double arrow 22 in FIG. 1. In turn, the two movable horizontal guides 50 bear a movable frame 52 able to slide telescopically relative to the guides 50 in the direction indicated by the double arrow 22. The movable frame 52 is provided with two pairs of idle wheels 54 which bear down on the floor.

Figure 9:
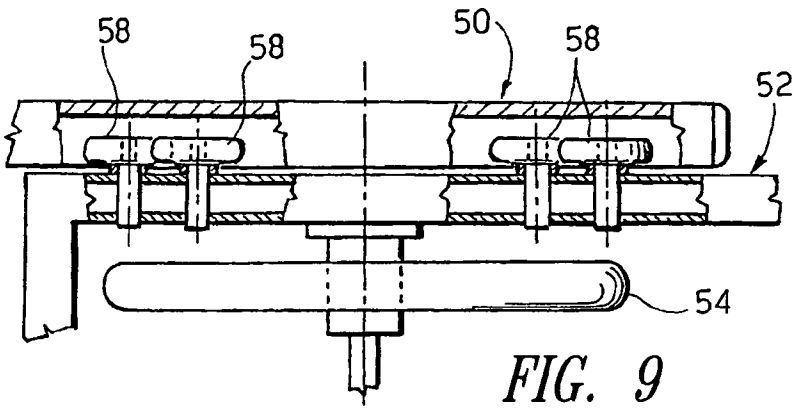
FIGS. 8 and 9 are view in enlarged scale of the parts designated by the arrows VIII and IX in FIG. 7.
Figure 8:
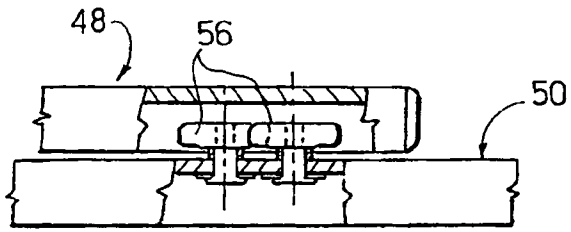
Figure 11:
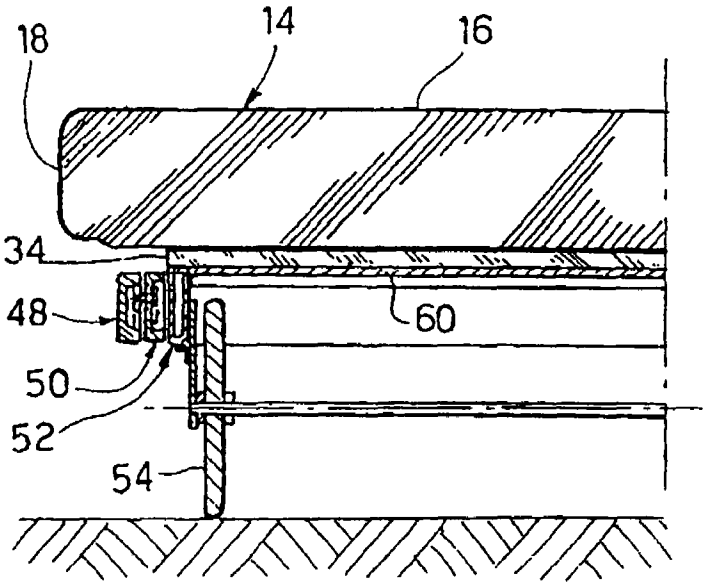
FIG. 11 is a section according to line XI—XI of FIG. 10.
Figure 10:
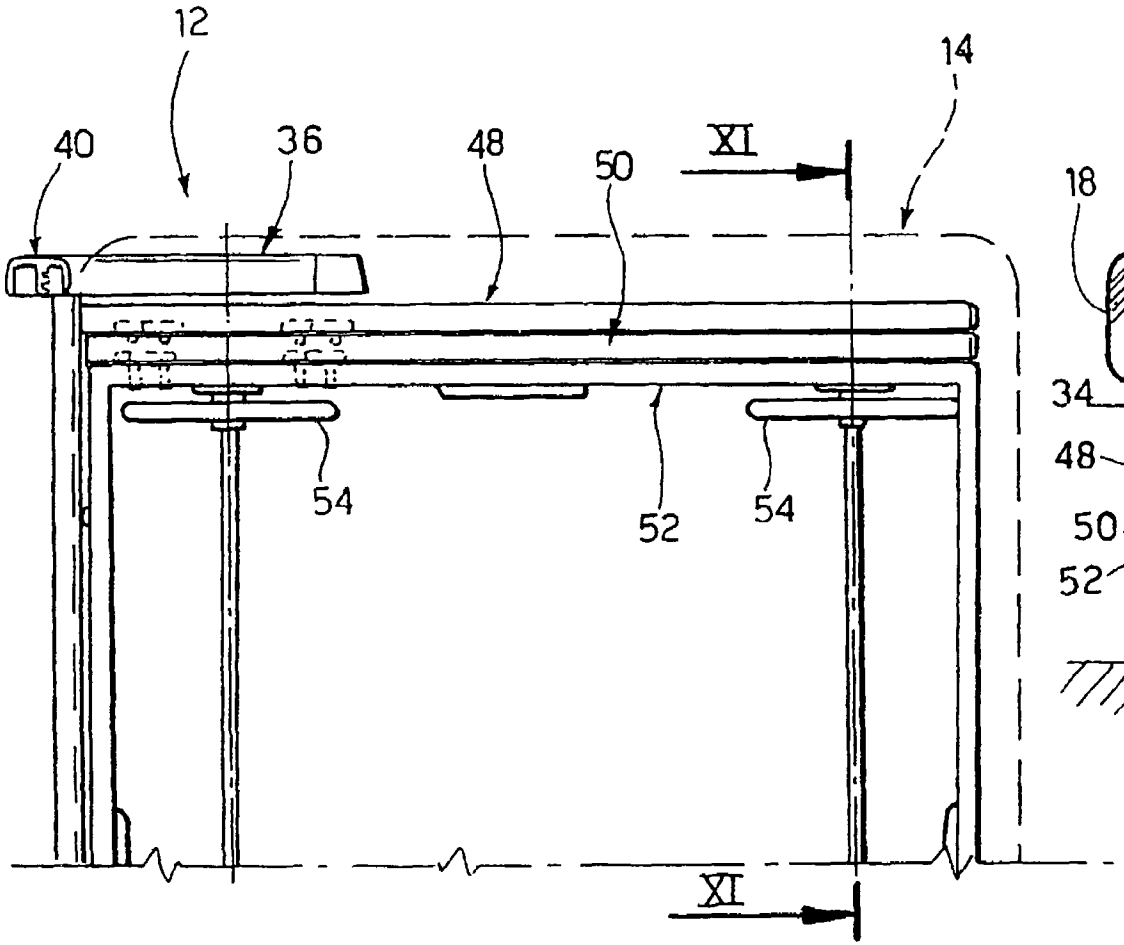
FIG. 10 is a partial plan view showing the support and guide structure of a sofa-bed in the retracted position.
Figure 12:
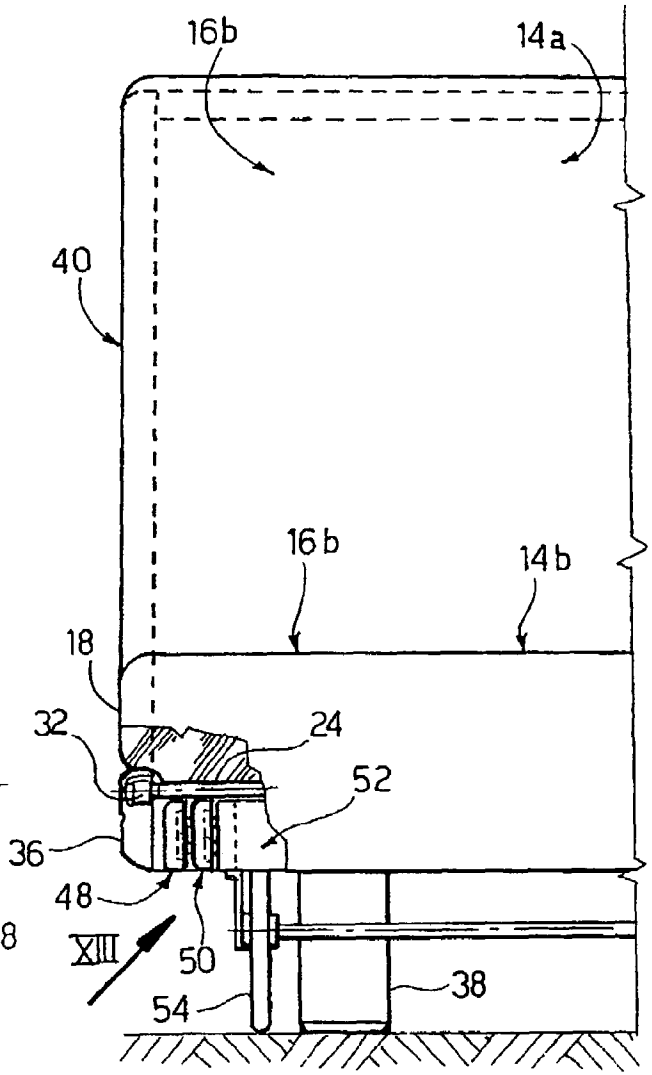
FIG. 12 is a partial front view of the sofa-bed according to the invention.
Figure 13:
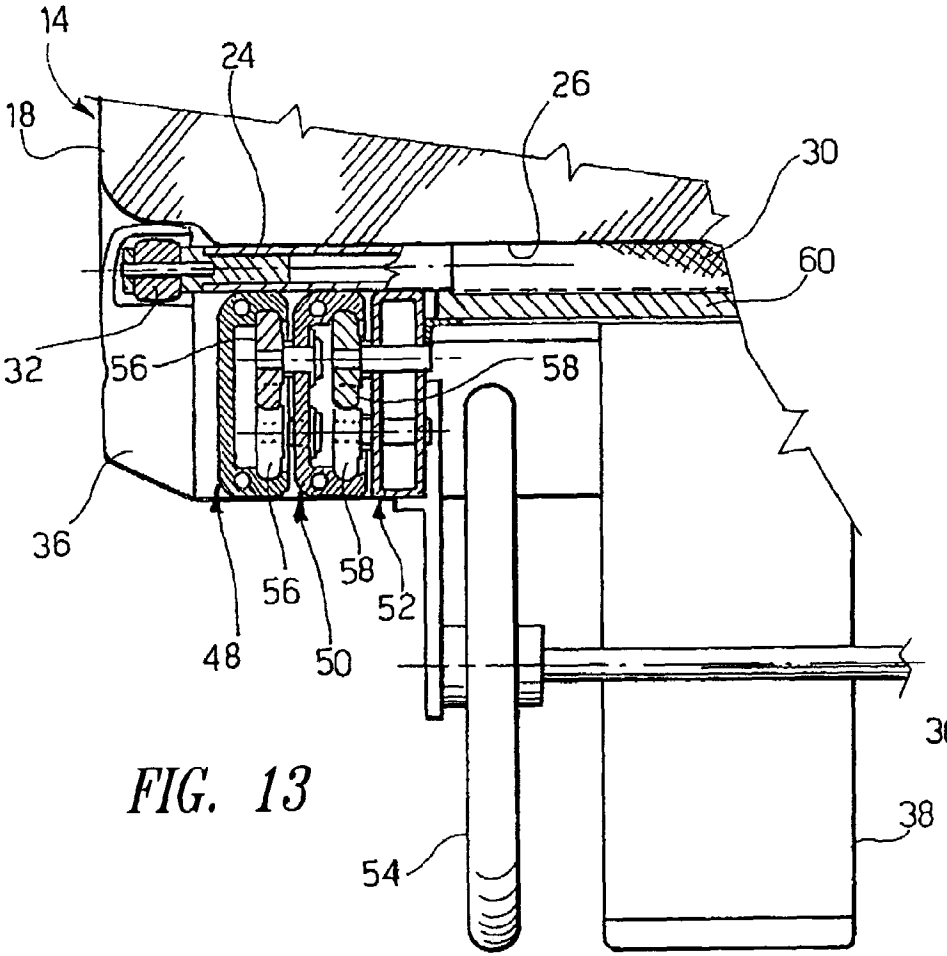
FIG. 13 is a partially sectioned front view showing in enlarged scale the detail designated by the arrow XIII in FIG. 12.

FIGS. 8, 9 and 13 show the node in which, according to a preferred embodiment of the present invention, is achieved the sliding connection between the movable guides 50 and the stationary guides 48 (FIG. 8) and the sliding connection between the movable frame 52 and the movable guides 50 (FIG. 9). Guides 48 and 50 are preferably constituted by aluminium section bars with substantially C shaped cross section. Each stationary guide 48 has an upper rolling track and a lower rolling track. Each of these tracks is engaged by two or more pairs of idle wheels 56 borne by the corresponding movable guide 50. in similar fashion, each movable guide 50 has an upper rolling track and a lower rolling track, each engaged by two or more pairs of idle wheels 58 borne by the movable frame 52.

The movable frame 52 is preferably provided with a support element 60 which can be formed by a panel or by a structure formed by a series of flexible belts.

Figure 7:
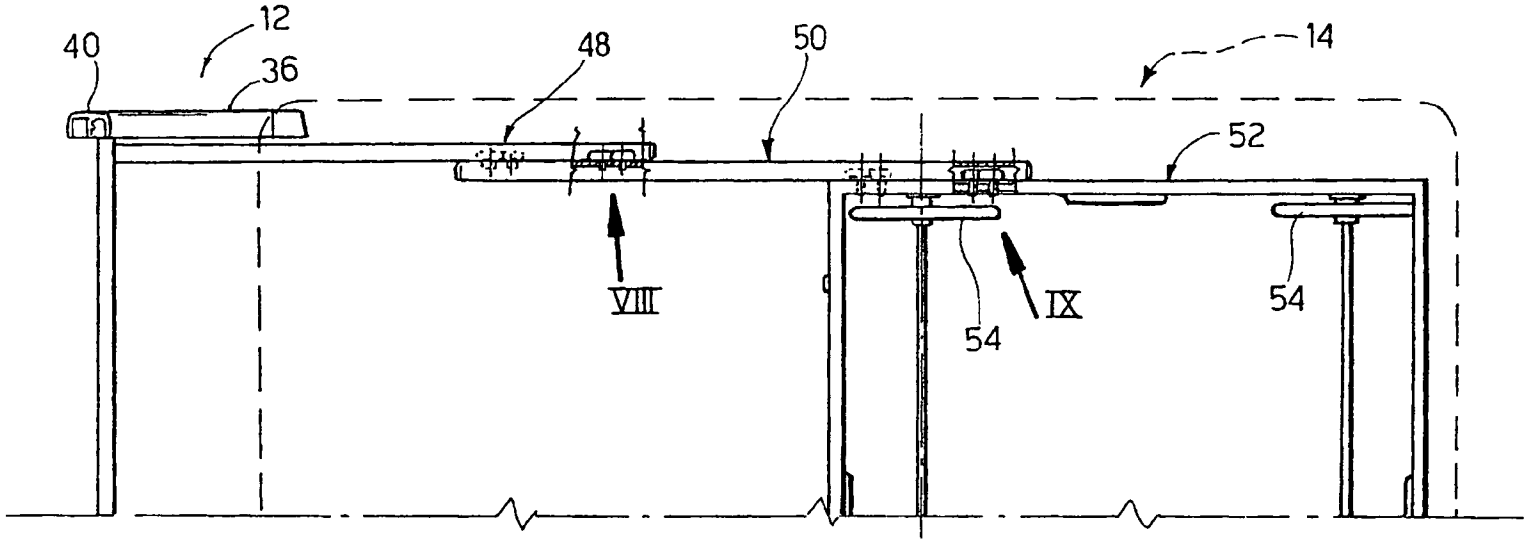
FIG. 7 is a partial plan view showing the support and guide structure of the sofa-bed according to the invention in the extended position.

The operation of the sofa-bed according to the present invention is as follows. Starting from the sofa configuration shown in FIG. 3, the user simply needs to pull the movable frame 52 in the direction indicated by the arrow 62 in FIG. 3 in order to shift to the bed configuration. The movable guides 50 and the movable frame 52 extend until reaching the position shown in FIGS. 2 and 7. The lower portion 14*b* of the mattress 14 is connected to the movable frame 52. Consequently, the movement from the retracted position to the extracted position of the movable frame 52 causes the movement of the mattress 52 from the sofa configuration shown in FIG. 3 to the bed configuration shown in FIG. 2. The guides 48 and 50 are provided with respective end stops which define the position of greatest extraction of the movable guides 50 and of the movable frame 52.

To return to the sofa configuration starting from the bed configuration, it is sufficient to push the movable frame 52 towards the guide uprights 40. During this motion, the upper part 14*a* of the mattress 14 moves upwards. The upward motion of the upper portion 14*a* of the mattress 14 is guided by the rollers 32 borne at the ends of the support rods 24 which engage in sliding fashion the guides 42 of the guide uprights 40.

The sofa-bed 10 can also be provided with a tubular pillow 64 separated from the mattress 14, which, in the sofa configuration, can be positioned in the junction area between the backrest portion 14*a* and the seat portion 14*b* of the mattress 14.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A convertible sofa-bed, comprising:

a support and guide structure;

a mattress movable relative to the support and guide structure between a bed configuration and a sofa configuration, the mattress having an upper portion and a lower portion, the lower portion extending horizontally and having a first bearing surface, the upper portion coupled to the lower portion and foldable upwards relative to the lower portion of the mattress, the upper portion having a second bearing surface, the mattress including a plurality of support rods to support at least a portion of the mattress on the support and guide structure, the support rods located in tubular seats sewn in a fabric covering of the mattress, the support rods each have an idle guide roller rotatably coupled to the respective support rod;

while in the sofa configuration, the upper portion of the mattress forms a backrest wherein the second bearing surface of the upper portion of the mattress is positioned to directly contact and support a back of an occupant when the occupant is in a seated position, and wherein the first bearing surface of the lower portion of the mattress forms a seating surface of the sofa-bed when the sofa-bed is in the sofa configuration.

* * * * *